United States Patent [19]

Valdenaire

[11] Patent Number: 4,919,407

[45] Date of Patent: Apr. 24, 1990

[54] APPARATUS FOR GRIPPING FRAMES

[75] Inventor: Jacques Valdenaire, La Bresse, France

[73] Assignee: Martival S.A., Le Thillot, France

[21] Appl. No.: 313,364

[22] Filed: Feb. 21, 1989

[30] Foreign Application Priority Data

Feb. 18, 1988 [FR] France ..... 88 02100

[51] Int. Cl.[5] ..... B25B 5/14

[52] U.S. Cl. ..... 269/118; 269/166

[58] Field of Search ..... 269/111-121, 269/166, 167, 329, 23

[56] References Cited

U.S. PATENT DOCUMENTS

| | | | |
|---|---|---|---|
| 685,078 | 10/1901 | Willringhaus | 269/120 |
| 704,553 | 7/1902 | Lindstrom | 269/114 |
| 2,923,334 | 2/1960 | Brennan, Jr. . | |
| 4,143,869 | 3/1979 | Paterson et al. | 269/166 |
| 4,468,018 | 8/1984 | Vaizey | 269/166 |
| 4,664,364 | 5/1987 | Lymburner | 269/329 |

FOREIGN PATENT DOCUMENTS

| | | |
|---|---|---|
| 0114174 | 8/1984 | European Pat. Off. . |
| 1196844 | 2/1961 | Fed. Rep. of Germany . |
| 1453244 | 9/1969 | Fed. Rep. of Germany . |
| 2413308 | 10/1975 | Fed. Rep. of Germany . |
| 2931517 | 2/1981 | Fed. Rep. of Germany . |
| 3246893 | 6/1984 | Fed. Rep. of Germany . |
| 3613742 | 11/1987 | Fed. Rep. of Germany . |

*Primary Examiner*—Robert C. Watson

*Attorney, Agent, or Firm*—Young & Thompson

[57] ABSTRACT

A gripping device for frames (1), comprised by a construction (2) for receiving the frames (1), by structure (3) for gripping the horizontal edges of the frames (1) and by structure (4) for gripping the vertical edges of the frames (1), characterized in that the structure (4) for gripping the vertical edges of the frames (1) is constituted by an arm movably mounted on the upper beam (5) of the construction (2) and provided with a device (6) for blocking it in operative position by bracing.

5 Claims, 2 Drawing Sheets

APPARATUS FOR GRIPPING FRAMES

The present invention relates to the field of woodworking, particularly the manufacture of furniture, especially chests, and has for its object an apparatus for gripping frames.

Apparatus for gripping frames now in existence are generally constituted by a rectangular construction at the interior of which are mounted with the possibility of displacement at least one vertical gripping element for the vertical edges of the frames to be assembled and horizontal gripping elements for the horizontal edges of the frames on the lower beam of the construction.

These known devices are either of the manually adjustable type in which at least one vertical element in the form of a movable arm may be fixed in position on the beams of the construction by means of pins or the like, the horizontal element being in the form of a girder mounted at the end of a jack displaceable in the upper horizontal beam and the girder forming the horizontal element being provided with horizontally acting jacks mounted so as to be adjustable in height on said girder, the lower jack being if desired mounted fixedly, and being either of the automatically adjustable type which is mechanical, hydraulic or pneumatic. The apparatus of this last type can have one or several horizontal elements displaceable form the upper horizontal beam in the direction of the lower horizontal beam of the construction by means of a Geneva mechanism or by linear drive means acting on the ends of the horizontal element or elements. These devices can moreover also be provided with gripping means for the vertical edges in the form of vertical elements also displaceable relative to the mountings of the construction by means of a Geneva mechanism or by linear drive means acting on the ends of these vertical elements.

These known gripping apparatus, commonly called framers, have however the drawback in the case of manually adjustable apparatus, of requiring relatively long adjustment time which is particularly disadvantageous in the case of small scale production.

The automatically adjustable gripping apparatus of course permit rapid adaptation of the adjustments as a function of the frames to be made but are however of high price which is incompatible with a small volume of production.

The present invention has for its aim to overcome these drawbacks.

It thus has for an object an apparatus for gripping frames constituted by a construction for receiving the frames, by means for gripping the horizontal edges of said frames and by gripping means for the upper edges of the frames, characterized in that the means for gripping the vertical edges of the frames is constituted by an arm movably mounted on the upper beam of the construction and provided with a device for being locked in operative position by bracing, i.e. by transon-locking.

The invention will be better understood from the following description, which relates to a preferred embodiment, given by way of non-limiting example, and explained with reference to the accompanying schematic drawings, in which.

Figure 2:
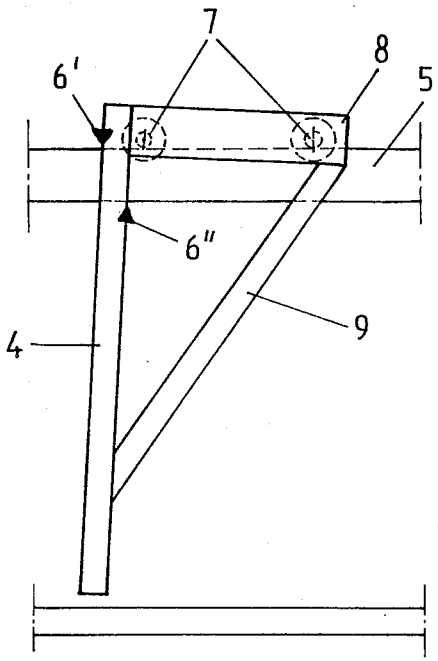
FIG. 2 is a fragmentary view of FIG. 1 showing the gripping means of the vertical edges in rest position and in displaced position along the upper beam of the construction.
Figure 1:
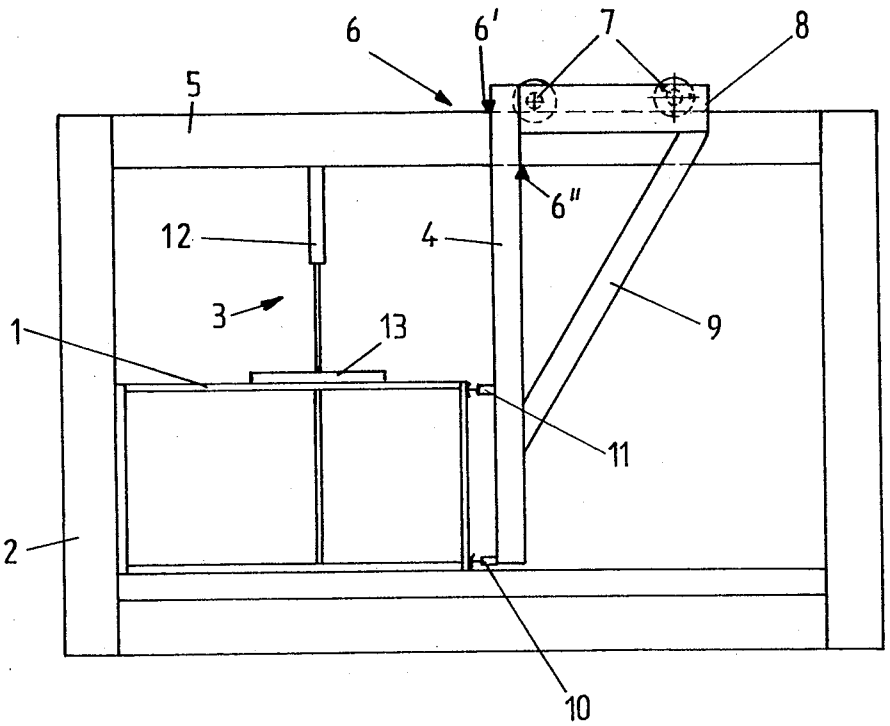
FIG. 1 is an elevational side view of an apparatus according to the invention, in operative position.
Figure 3:
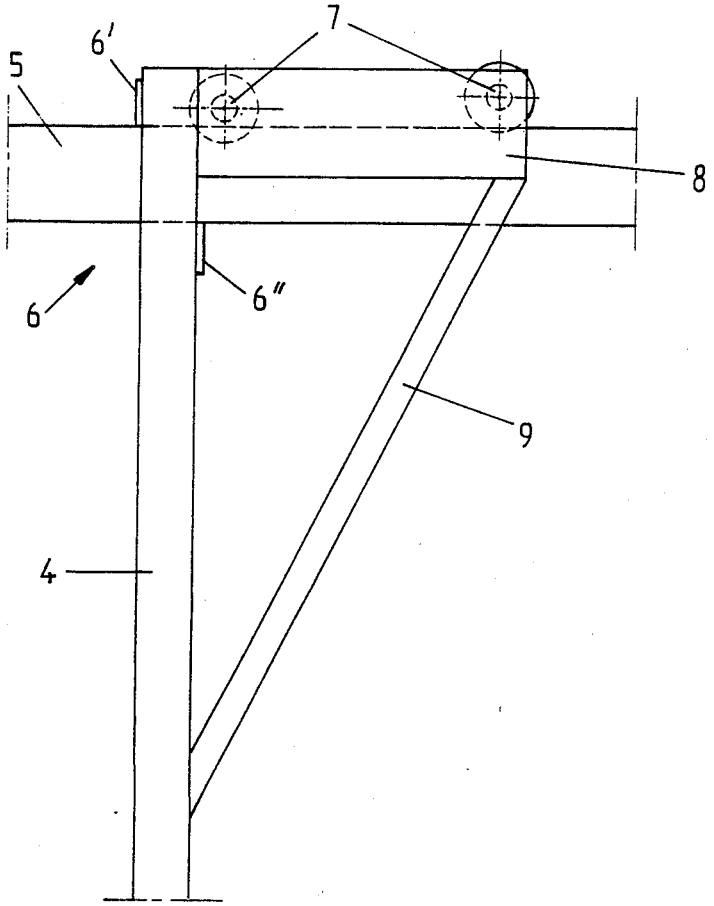
FIG. 3 is a partial view on a larger scale corresponding to that of FIG. 2, showing the blocking device in operative position.

According to the invention and as shown more particularly by way of example in FIG. 21 of the accompanying drawings, the apparatus 1 for gripping frames which is constituted by a construction 2 for the reception of the frames 1, by means 3 for gripping the horizontal edges of said frames 1 and by means 4 for gripping the vertical edges of the frames 1, is characterized in that the means 4 for gripping the vertical edges of the frames 1 is constituted by an arm movably mounted on the upper beam 5 of the construction 2 and provided with a device 6 for locking in operative position by bracing.

The device 6 for blocking in operative position by bracing is preferably constituted by two abutments 6′ and 6″ mounted (6′) on the side of the arm 4 that faces the frame 1 above the upper beam 5 of the construction 2 and the other (6″) on the opposite side of arm 4 below the upper beam 5 of the construction 2.

The arm 4, comprising the gripping means for the vertical edges of the frames 1, is fixed to a frame rolling on the beam 5 provided with two grooved rollers 7 whose flanges straddle the beam 5, said frame being constituted, on the one hand, by a horizontal member 8 secured to the upper end of the arm 4 and bearing the rollers 7 and, on the other hand, by a brace 9 connecting the free end of the member 8 to the arm 4 substantially at its lower portion.

The rollers 7 of the rolling chassis are preferably mounted on the horizontal element 8 of this latter with the height of their axes offset, the axis of the roller 7 farthest from the arm 4 being disposed at a higher level on the element 8 than the axis of the roller 7 nearer the arm 4 and the abutments 6′ and 6″ are disposed on the arm 4 with a spacing corresponding to the height of the beam 5, in the operative position of the arm 4, the roller 7 nearer the arm 4 being slightly raised from the beam 5 in this said operative position. Thus, in the out-of-use position of the arm 4, this latter is slightly inclined relative to the vertical, in the direction of the frame to be gripped, the two rollers 7 of its rolling chassis resting on the beam 5 and the abutments 6′ and 6″ each having play relative to the corresponding face of said beam 5. Thus the spacing between the opposite sides of the abutments 6′ and 6″ being equal to the height of the beam 5 in the gripping position of the frame 1 by bracing, that is to say the abutments 6′ and 6″ each bearing by one surface on said beam 5 and the roller 7 farther from the arm 4 being raised from the beam 5, the roller 7 nearer the arm 4 being slightly raised from the beam 5, during the return of the arm 4 into the non-use position, there takes place a pivoting of the assembly of arm 4 and the rolling chassis about the axis of the roller 7 nearer the arm 4, after it comes into contact with the beam 5, which has the effect of spacing said abutments 6′ and 6″ from their point of bearing on the beam 5.

In known manner, the arm 4 is provided at its free end with a jack 10 bearing on the edge of the lower portion of frame 1 to be gripped and the means 3 for gripping the horizontal edges of the frames 1 is constituted by one or several vertically acting jacks 12, whose piston rod bears by means of a horizontal bar 13 on the upper edges of said frames 1.

According to a characteristic of the invention, the arm 4 can be provided with one or several jacks 11 which are movable vertically, for gripping the vertical edges of the frame 1, the displacement of these jacks 11 being effected by means of other vertical displacement jacks, or by manual adjustment. Thus, it is possible to adapt these vertical gripping jacks to the vertical dimensions of the frames 1 to be gripped.

Using the apparatus according to the invention is performed by a simple displacement of the arm 4 together with its rolling chassis along the beam 5 of construction 2 in the direction of the frame 1 to be gripped until it arrives in abutment with the jack 10 provided on the free end of arm 4, against the lower portion of the vertical edge of the frame 1. Under the effect of the inertia of the assembly of arm 4 and the rolling chassis, there takes place a bracing of the arm 4 by the abutments 6' and 6''. The effect of the obtained bracing is increased upon pressurizing the jack 10 and the jack or jacks 11, the gripping force exerted by these latter having the result of imposing a theoretical pivoting coupled about the abutments 6' and 6'' and accordingly increasing their bearing force on the corresponding faces of the beam 5.

According to a modified form of the invention, not shown in the accompanying drawings, the arm 4 or its rolling frame can be provided with a displacement control device in the form of a jack whose stoppage is controlled by a feeler located adjacent jack 10 on the free end of the arm 4. In this embodiment, the operator can control the actuation of the displacement jack of the arm 4, the deactuation of this jack automatically taking place upon the coming into abutment of the jack 10 against the frame 1 to be gripped. It is thus possible for the operator to effectuate any desired twohanded operation before the arm 4 comes into abutment.

The device according to the invention permits rapidly and effectively achieving a gripping of the vertical edges of the frames to be assembled and instantaneous adaption of the gripping means of the vertical edges of the frames to the dimensions of these latter.

Thanks to the invention, it is possible to provide apparatus for gripping frames, which will be of simple construction, low cost and which may be easily operated.

Of course, the invention is not limited to the embodiment described and shown in the accompanying drawings. Modifications remain possible, particularly as to the construction of the various elements or by substitution of technical equivalents, without thus departing from the scope of protection of the invention.

What is claimed is:

1. Apparatus for gripping members (1), comprising a construction (2) for reception of the members (1), said construction having mounted thereon means (3) for gripping horizontal edges of said members (1) and means (4) for gripping vertical edges of said members comprising an arm, said construction (2) having an upper beam (5), roller means (7) supporting said arm on said upper beam (5) for rolling movement on said upper beam (5) toward and away from said members (1), and two abutments (6', 6'') carried by said arm and so disposed on opposite sides of said upper beam as to grip said upper beam when said arm presses against said members (1) thereby to lock said arm to said upper beam (5), said roller means (7) being so disposed that when said arm rests on said rollers out of contact with said members (1), said abutments (6', 6'') release said upper beam (5) thereby to permit free rolling movement of said arm on said upper beam (5).

2. Apparatus according to claim 1, in which said roller means (7) comprises a pair of rollers spaced apart horizontally along said upper beam (5), said two rollers being so mounted on said arm that when said arm presses against said members (1) at least one of said rollers is out of contact with said upper beam but when said arm is out of contact with said members (1), both of said rollers are supported on said upper beam (5).

3. Apparatus according to claim 1, said arm comprising a horizontal member (8) at the upper end of the arm, said horizontal member (8) carrying said roller means (7), and a brace (9) connecting a free end of said horizontal member (8) to a lower portion of said arm.

4. Apparatus according to claim 1, and jack means (11) for increasing the pressure between the arm and said members (1).

5. Apparatus according to claim 1, and a vertical jack (12) acting between said upper beam (5) and said members (1) to press down on said members (1).

* * * * *